US005174184A

United States Patent [19]

Meeks

[11] Patent Number: 5,174,184

[45] Date of Patent: Dec. 29, 1992

[54] SLOTTER HEAD ASSEMBLY HAVING PNEUMATICALLY LOCKED SLOTTER BLADES

[75] Inventor: William R. Meeks, Lawrence, Kans.

[73] Assignee: Lawrence Paper Company, Lawrence, Kans.

[21] Appl. No.: 884,771

[22] Filed: May 18, 1992

[51] Int. Cl.[5] ..... B26D 7/26

[52] U.S. Cl. ..... 83/332; 83/676; 83/699

[58] Field of Search ..... 83/676, 665, 332, 699; 493/475, 368, 471, 370

[56] References Cited

U.S. PATENT DOCUMENTS

| | | | |
|---|---|---|---|
| 3,073,198 | 1/1963 | Clem | 83/665 X |
| 3,772,953 | 11/1973 | Sullivan | 83/332 |
| 3,951,024 | 4/1976 | Weiskopf | 83/665 X |
| 3,985,066 | 10/1976 | Kern | 83/332 X |
| 4,471,679 | 9/1984 | Spengler | 83/699 X |
| 4,502,357 | 3/1985 | Hussissian | 83/332 |
| 5,107,737 | 4/1992 | Tagliaferri | 83/676 X |

*Primary Examiner*—Frank T. Yost
*Assistant Examiner*—Rinaldi Rada
*Attorney, Agent, or Firm*—Hovey, Williams, Timmons & Collins

[57] ABSTRACT

A rotatable slotter head assembly (20) of the type used in the slotting of box blanks is provided which includes mechanism (28) permitting rapid and easy alteration of the circumferential position of the cutting knives, (26) carried by the assembly (20). Preferably, the assembly (20) includes a rotatable body (24) provided with an elongated, peripheral, knife-receiving slot (68) defined by fixed backing plates (58) and laterally shiftable locking plates (86–96). A plurality of selectively inflatable resilient bladders (74–78) are carried by the head assembly (20) and, when inflated, shift the associated movable locking plates (86–96) against the cutting knives (26), thereby firmly locking the latter in place. When knives adjustment is desired, one or more of the appropriate bladders (74–78) are deflated, the knives (26) are shifted as desired, and the bladders (74–78) are reinflated.

13 Claims, 3 Drawing Sheets

SLOTTER HEAD ASSEMBLY HAVING PNEUMATICALLY LOCKED SLOTTER BLADES

BACKGROUND OF THE INVENTION

1. Field of the Invention

The present invention is broadly concerned with an improved slotter head assembly of the type used in boxmaking equipment for forming flap-defining slots in box blanks. More particularly, it is concerned with such a slotter head assembly which is improved by provision of a pressurized fluid-actuated mechanism for selectively locking the slotter blade knives in position, while permitting ready adjustment of the knife positions. In this fashion, the box blank slotting equipment can be readily altered to produce blanks of different configurations without the need for time-consuming manual knife adjustments. In preferred forms, the pressurized fluid-actuated mechanism includes an elongated, pneumatic bladder positioned adjacent the corresponding knife blades, and operable upon filling of the bladder to engage and lock the knives in place.

2. Description of the Prior Art

The manufacture of box blanks on an industrial scale normally involves slotting and creasing of precut corrugated sections, in order to create a blank having the requisite fold lines and flaps for a given box. Normally, the slotting equipment used for this purpose includes an elongated shaft carrying a plurality of annular rotatable slotter heads. Normally, a pair of slotting knives are secured to each head for rotation therewith. The circumferential spacing of the slotter knives thus determines the depth of the flap-defining slots for a given blank.

A persistent problem in the box-making industry stems from the time and effort required to change the position of slotting knives on the individual slotting heads. That is to say, after a given box blank run is completed, it is often necessary to change the circumferential location of the knives in order to produce in the next run blanks of different configuration. Generally speaking, prior art slotter heads are equipped with a series of threaded bores in the sidewall thereof, for attachment of the slotted knives by means of bolts. When it is necessary to change the location of one or more of the knives, it is necessary to remove the knife-retaining bolts, relocate the knife to a desire position, and reinstall the bolts. This practice can be relatively time-consuming, especially when it is considered that a number of heads need to be changed for each run. Moreover, the slotter heads are located within large blankforming equipment, and it is sometimes to difficult to gain access to the heads for knife changeover.

Accordingly, there is a real and unsatisfied need in the art for a simplified slotter head and knife arrangement which will allow quick knife adjustment without the need for removing and reinstalling bolts or other mechanical fasteners.

SUMMARY OF THE INVENTION

The present invention overcomes the problems outlined above, and provides a knife assembly in the form of a head presenting a knife-receiving slot in the periphery thereof, with one or more knives being adjustably positioned within the slot. Means is provided for releasably locking the knives within the slot, including pressurized fluid-actuated mechanism adjacent the slot for selectively engaging and locking knives in place.

In preferred forms, the head is in the form of an annular, rotatable body having an elongated slot in the periphery thereof permitting placement of one or more knives at any one of a number of positions around the slot. Moreover, the knife-locking mechanism advantageously includes structure defining a fluid-receiving cavity, with means for permitting selective filling of the cavity with pressurized fluid and for selectively draining pressurized fluid therefrom. Filling the cavity creates a locking action on the knives while fluid drainage releases the knives.

In actual practice, one or more elongated pneumatic bladders formed of resilient synthetic resin material are provided within the rotatable head, and conventional valve means is coupled with each bladder to permit selective inflation thereof with pressurized air, or alternately deflation thereof. One or more shiftable plates are provided adjacent the bladders and are movable laterally to a limited degree in response to filling or draining of the bladders. The shiftable plates are oriented for engaging the knives, so that upon inflation of the appropriate bladders, the corresponding knives are rigidly locked in place along the knife-receiving slot of the head. When it is desired to change the knife position, it is only necessary to partially or completely deflate the corresponding bladders, whereupon the knives can be manually moved to the next position and relocked by reinflation of the bladders.

In further preferred forms of the invention, a complemental rib and slot retainer arrangement is provided between the knives and the head for preventing detachment of the blades from the knife-receiving slot in the event of unintended draining of pressurized fluid from the bladders. Such a retainer arrangement insures that the blades will remain within the knife-receiving slot of the head even during high speed rotation thereof.

DETAILED DESCRIPTION OF THE PREFERRED EMBODIMENT

Figure 2:
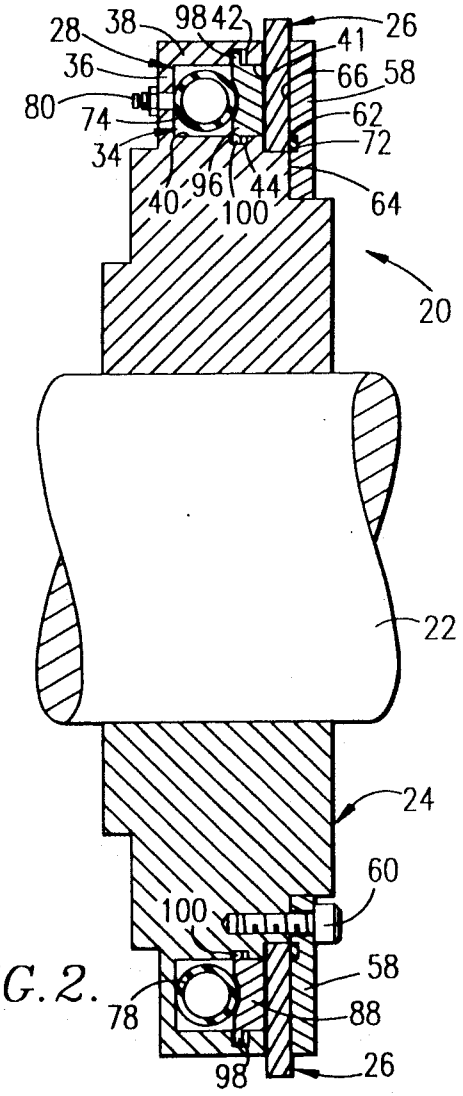
FIG. 2 is a sectional view taken along line 2—2 of FIG. 1 and illustrating the head bladders in their relaxed positions permitting circumferential adjustment of the knives.
Figure 1:
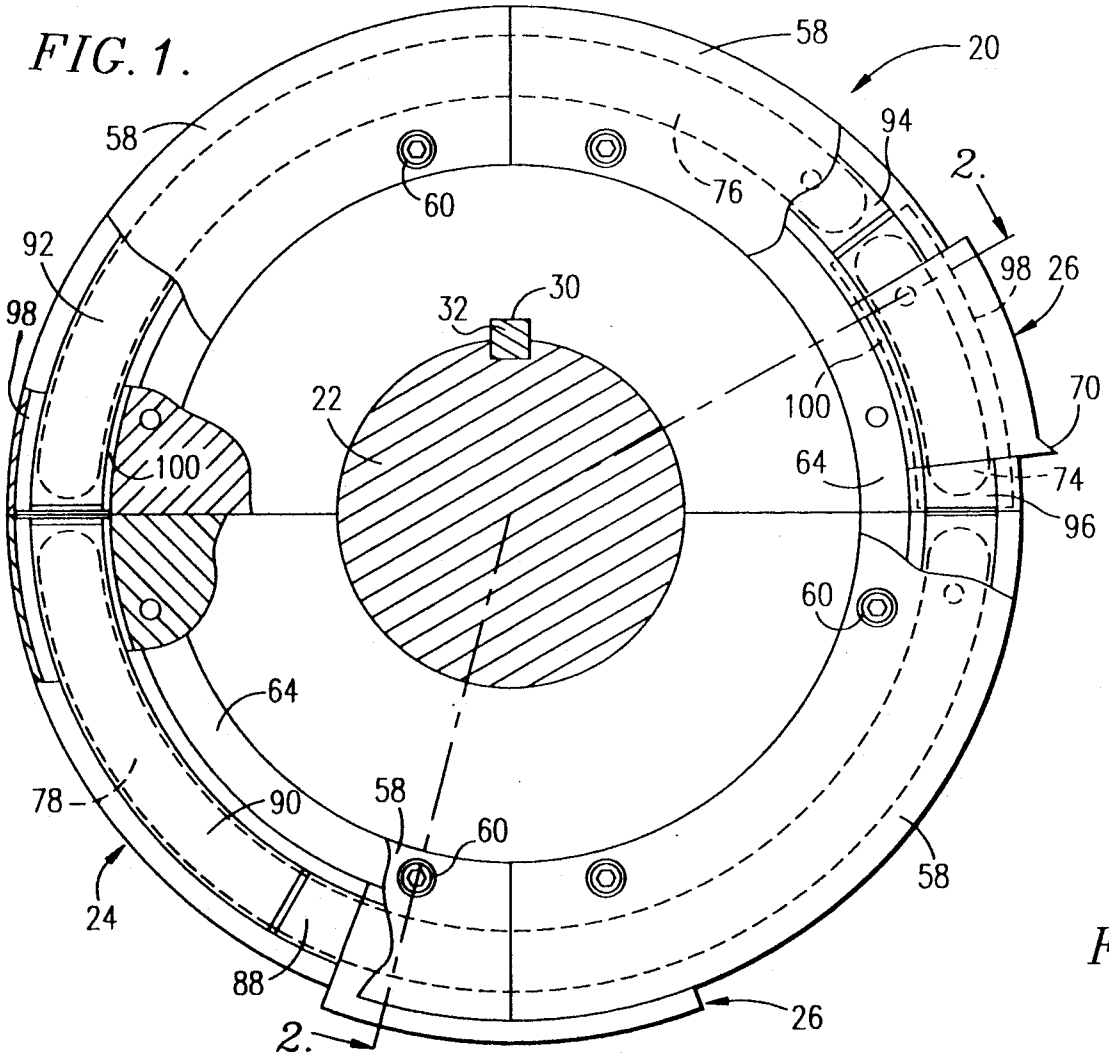
FIG. 1 is a side view of a slotter head in accordance with the invention, shown with a pair of slotting knives secured therein, and with parts broken away and certain components of the assembly being shown in phantom.
Figure 3:
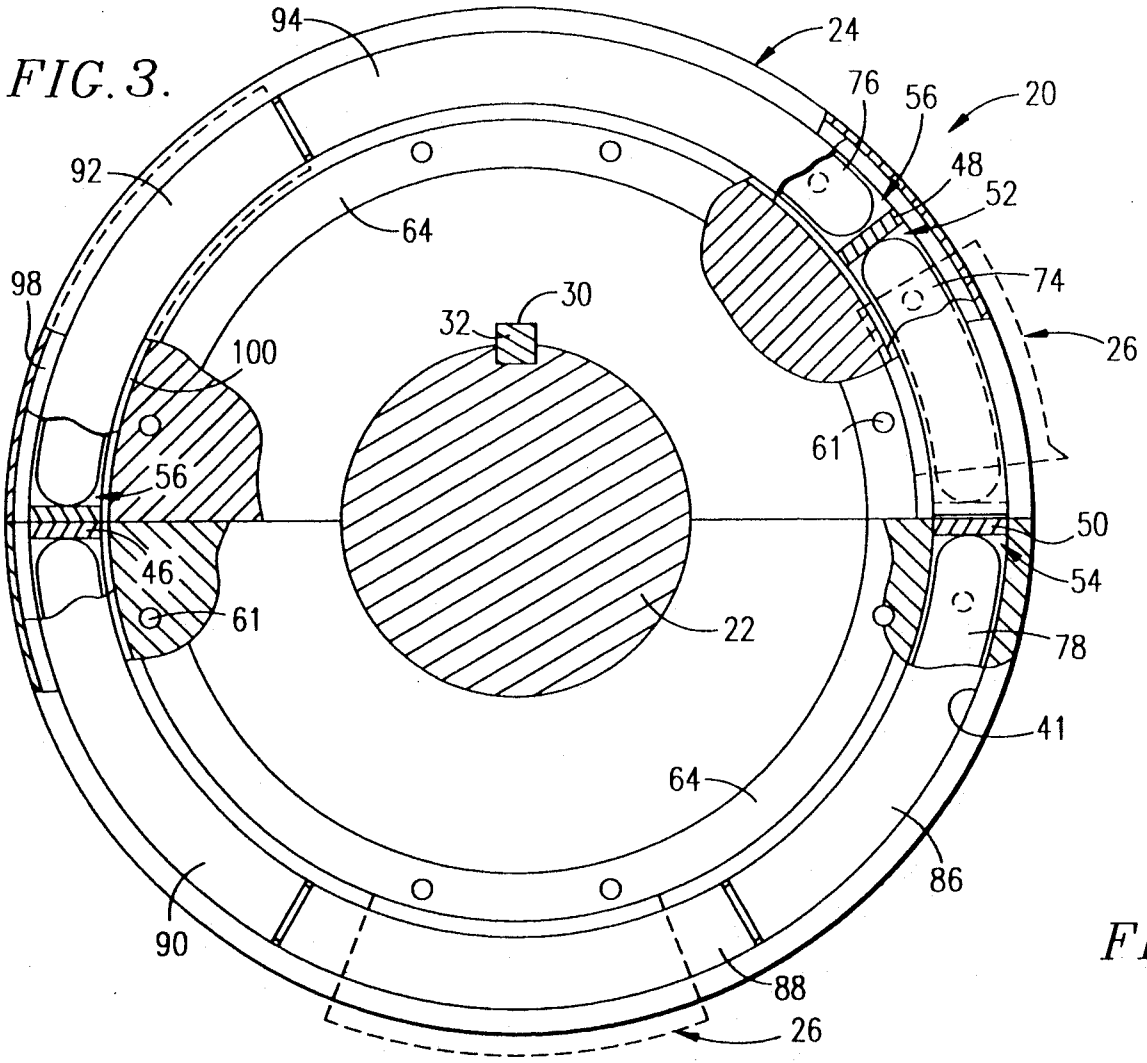
FIG. 3 is a view similar to that of FIG. 1, but illustrating the head backing plates removed, the knives illustrated in phantom, and with additional parts broken away to reveal the internal structure of the slotter head.
Figure 10:
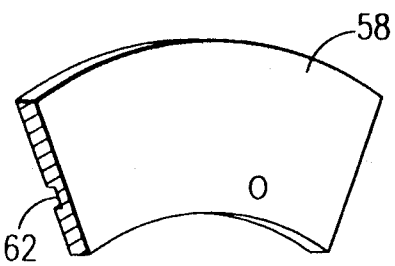
FIG. 10 is a perspective view of a stationary knife backing plate, equipped with a rib-receiving slot along the inner face thereof.
Figure 9:
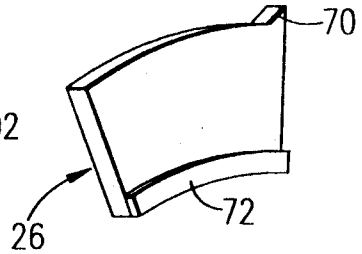
FIG. 9 is a perspective view of a tip knife, showing a knife-retaining rib adjacent the inner surface thereof.

Turning now to the drawings, and particularly FIGS. 1-3, a slotter head assembly 20 is illustrated, as it would appear when mounted upon a rotatable shaft 22. Broadly speaking, the head assembly 20 includes an annular main body 24, at least one knife 26 carried by the body 24, and mechanism broadly referred to by the numeral 28 carried by the body 24 and operable for selectively engaging and locking the knives 26 in place.

Figure 7:
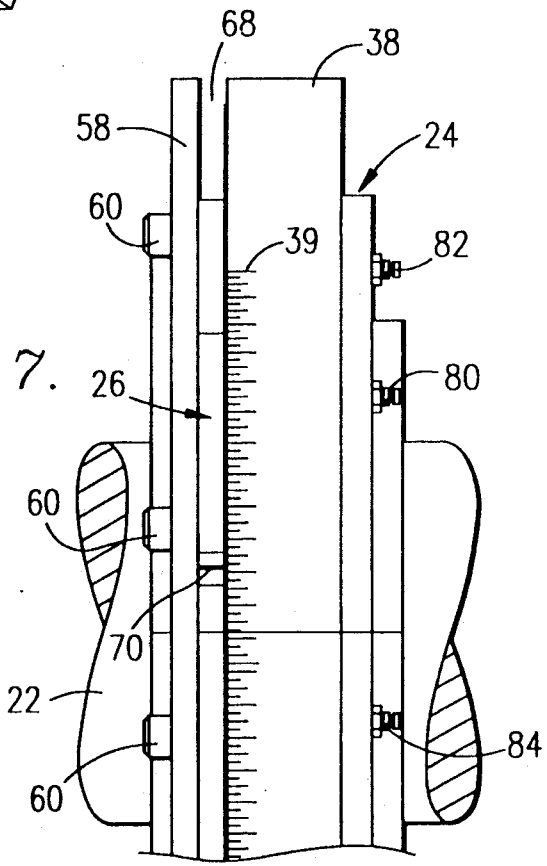
FIG. 7 is a fragmentary end view of a slotter head in accordance with the invention showing scale marks on the periphery of the head permitting accurate location of the head knives.

In more detail, the main body 24 is annular in configuration and has an innermost keyway 30 adapted to receive a locking key 32 associated with shaft 22. The radially outermost section of body 24 includes an elongated, continuous recess 34 which extends circumferentially about the main body and is defined by a sidewall section 36, outboard wall 38 and inner body surface 40; the recess 34 thus presents a lateral opening 41 as best seen in FIG. 2. It will further be observed that the wall 38 and surface 40 are provided with short, radially and circumferentially extending keeper slots 42, 44, just inboard of the lateral opening 41. Moreover (see FIG. 7), the outer surface of wall 38 includes a series of scale markings 39, the purpose of which will be described. Referring to FIGS. 2 and 3, it will be noted that the recess 34 has a total of three end walls 46, 48, and 50 located therein in circumferentially spaced relationship to cooperatively define a relatively short, elongated bladder-receiving zone 52, as well as longer bladder-receiving zones 54 and 56. The walls 46, 50 are each formed from a pair of abutting wall-defining segments as shown.

A total of four arcuate, apertured, stationary backing plates 58, each extending essentially 90° about the circumference of body 24, are affixed to the latter as best seen in FIGS. 1 and 2 by means of bolts 60 extending into threaded bores 61 in the body. Each backing plate 58 includes an arcuate knife-retaining slot 62 on the inner face thereof. Furthermore, the backing plates 58 abut a shoulder region 64 of main body 24, thereby defining between the inner surfaces 66 of the backing plates, and the opposed recess-defining structure, a continuous knife-receiving slot 68 extending circumferentially about the periphery of main body 24.

In the illustrated embodiment, a pair of cutting knives 26 are provided. One of the knives includes a tip 70 as is conventional in equipment of this type, and is in practice normally positioned at the zero or reference point of the head and not thereafter moved. The remaining knife 26 is normally shifted circumferentially relative to the tip knife in order to alter the length of slots cut using the head. The knives 26 are themselves conventional, except that they are each provided with an elongated, integral, outwardly extending retaining rib 72 adapted to be received within the rib slots 62 of the plates 58.

Figure 6:
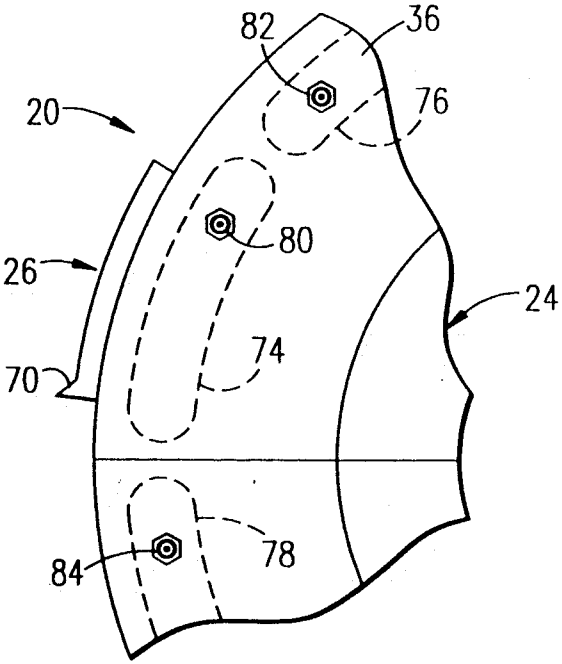
FIG. 6 is a fragmentary view of the slotter head assembly, depicting the location of bladder filling valves permitting filling and drainage of the respective bladders with pressurized air.

The locking mechanism 28 associated with head assembly 20 includes, in the embodiment illustrated, a total of three elongated pneumatic bladders 74, 76, and 78. As illustrated, the bladder 74 is located within zone 52 between end walls 48 and 50, and is relatively short. On the other hand, bladder 76 is located between walls 46, 48 within zone 56 and extends approximately 120° about the circumference of the head. Finally, bladder 78 is located within zone 54 between walls 46 and 50, and extends a full 180° about the head. Each of the bladders 74-78 is equipped with a conventional inflation/deflation valve 80, 82, and 84 which extends through the sidewall section 36 as best seen in FIGS. 2 and 6.

Figure 8:
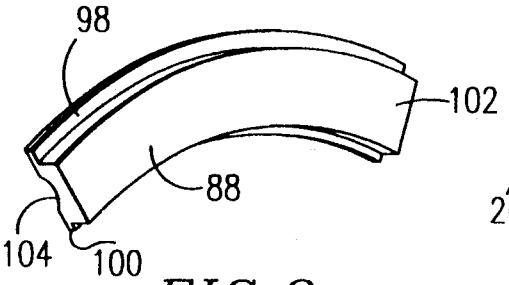
FIG. 8 is a perspective view illustrating the construction of a shiftable, knife-locking plate forming a part of the knife locking mechanism.

The mechanism 28 further includes a total of six laterally shiftable knife locking plates 86, 88, 90, 92, 94, and 96 which are located within the lateral opening 41 and cooperatively fill the latter, being placed in end-to-end adjacency for this purpose. As best seen in FIGS. 2 and 8, each of the locking plates 86-96 is arcuate in configuration and includes outer and inner projections 98, 100 respectively situated within the keeper slots 42, 44. In this fashion, the individual plates 86-96 can move laterally within the opening 41 to a limited degree. Each backing plate also presents a substantially planar knife-engaging surface 102, as well as an opposed, inner, arcuate bladder-engaging surface 104. Finally, it will be seen that the backing plates 86-92 each extend approximately 60° about the circumference of the head, whereas plate 94 is somewhat longer and plate 96 is shorter still, essentially covering only the region corresponding to short bladder zone 52.

Figure 4:
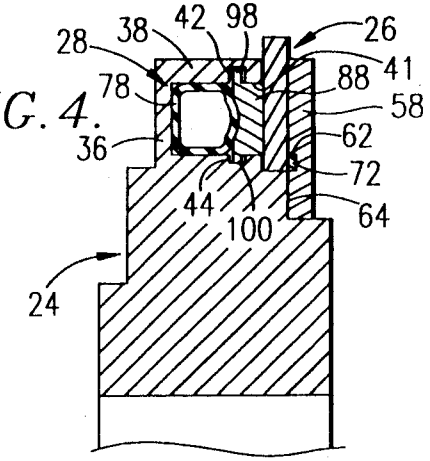
FIG. 4 is a fragmentary vertical sectional view illustrating the configuration of a knife-locking bladder in its operative position serving to lock a knife blade in place.
Figure 5:
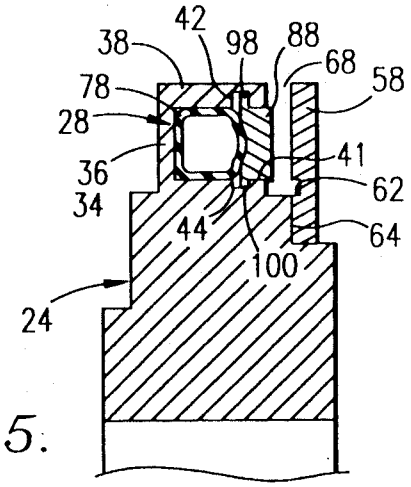
FIG. 5 is a view similar to that of FIG. 4, and showing the knife-receiving slot in detail.

The use and operation of assembly 20 will next be described. It will be assumed that the knives 26 forming a part of the head assembly are properly positioned for a given blank-forming run. Specifically, the tip knife is properly located at the zero or reference point of the head, and bladder 74 is fully inflated. Likewise, the shiftable blade is positioned as desired using head markings 39, and the appropriate bladder 78 is fully inflated. At the end of the blank run, if it is desired to alter the position of the movable blade 26, it is only necessary to deflate bladder 78 through the use of valve 84, until the bladder assumes the relaxed position illustrated in FIG. 2. At that point it is a simple matter to manually shift the movable blade along the periphery of the head assembly while the blade is retained within the slot 68. Complete removal of the blade at this time is prevented, inasmuch as the blade rib 72 is located within the slots 62 of the backing plates 58. Once the movable blade has been positioned to a new desired position, the bladder 78 is reinflated with pressurized air, again using the valve 84. It will be appreciated that inflation of the valve 78 serves to laterally shift the associated backing plates 86, 88 and 90 rightwardly as viewed in FIGS. 4 and 5, so that the appropriate blade-engaging surfaces 102 thereof firmly contact the movable knife and press it against the adjacent backing plate 58. This serves to firmly lock the knife 26 in place.

Of course, in the event that it is desired to shift the movable knife 26 to a location adjacent the bladder 76, the latter would be deflated to permit such movement, and then reinflated. The end walls 46-50 positioned adjacent the respective ends of the bladders prevent substantial axial expansion of the bladders upon inflation thereof, thereby maximizing the extent of lateral movement of the locking plates, and the locking force extended on the knives 26.

As indicated previously, in normal practice, the tip knife 26 would not be moved inasmuch as it defines the zero or reference position for the head assembly. Nevertheless, if movement of this knife is desired, such would be effected in a manner described above.

The knives 26 are retained within the slot 68 during high speed rotation of head assembly 20, even in the event that one or more of the bladders unintentionally deflates. This retention is afforded by means of the knife ribs 72 and the complemental rib-receiving slots 62 of the backing plates 58. Of course, use of this retention structure requires that the backing plates 58 be removed when it is desired to completely disassemble the head assembly 20 and remove the knives 26 therefrom. However, this need be done only periodically, and therefore does not present a significant drawback.

I claim:

1. A knife assembly, comprising: a head presenting a periphery and having knife-receiving slot in said periphery thereof; a knife positioned within said slot; and means for releasably locking said knife within said slot, including pressurized fluid-actuated mechanism adjacent said slot for selectively engaging said knife and locking the knife in the slot, said mechanism including structure defining a fluid-receiving cavity, means for selectively filling the cavity with pressurized fluid and for selectively draining pressurized fluid therefrom, and shiftable means for engaging said knife in response to filling of said cavity.

2. The assembly of claim 1, said head being rotatable, said peripheral slot permitting placement of the knife at any one of a number of positions along the length of the slot.

3. The assembly of claim 1, said cavity-defining structure comprising an elongated bladder formed of resilient material, said filling and draining means including an inflation/deflation valve operably coupled with said bladder.

4. The assembly of claim 1, said shiftable means including a shiftable plate movable in response to filling of said cavity into locking engagement with said blade, said plate being shiftable away from said blade upon draining of the cavity for permitting movement of said blade.

5. The assembly of claim 1, including retaining means for preventing removal of said blade form said slot in the event of unintended drainage of pressurized fluid from said cavity.

6. The assembly of claim 5, said retaining means comprising a rib carried by one of said blades and the slot-defining structure of said head, and a complemental rib-receiving opening carried by the other of said blade and slot-defining structure.

7. The assembly of claim 1, including a pair of spaced apart knives within said slot, there being an individual, selectively operable pressurized fluid actuatable mechanism for each of said blades respectively.

8. A rotatable slotter head, comprising:

a rotatable body including a pair of opposed, arcuate plates adjacent the periphery of the body cooperatively defining therebetween an elongated, knife-receiving slot adjacent said periphery, one of said plates presenting a pair of opposed side faces being and mounted for limited travel thereof towards and away from the opposed plate;

an elongated pneumatic bladder carried by said body and located for engagement with the side face of said one plate remote from said opposed plate; and means for selectively inflating said bladder with pressurized air for movement of the one plate towards said opposed plate in order to engage and lock a knife, and for permitting selective deflation of said bladder for releasing said knife.

9. The head of claim 8, including means for retaining said knife within said slot in the event of unintended deflation of said bladder.

10. The head of claim 9, said retaining means comprising a rib carried by one of said knife and said other plate, and a complemental, rib-receiving opening carried by the other of said knife and other plate.

11. The head of claim 8, said bladder presenting a pair of closed ends, there being rigid wall means carried by said body adjacent each of said bladder ends for inhibiting axial expansion of the bladder upon inflation thereof.

12. A knife assembly, comprising:

an elongated, axially rotatable shaft;

an annular head presenting a periphery and a pair of opposed, laterally spaced apart walls extending inwardly from said periphery and cooperatively defining a knife-receiving slot therebetween;

said head mounted on said shaft for rotation of the head and said slot-defining walls with the shaft at all times;

an arcuate knife having a length substantially less than the length of said knife-receiving slot and positioned within the slot; and means for releasably locking said knife within said slot, including fluid-actuated mechanism having structure for selective and alternate placement of the mechanism in either a pressurized or a depressurized condition, and knife-engaging means operably coupled with said mechanism for engaging said knife when said mechanism is in one of said conditions for locking the knife in place in a desired position within said slot, and for releasing said knife when said mechanism is in the other of said conditions for permitting shifting movement of the knife within and along the length of said slot and relative to both said shaft and both of said slot-defining walls, in order to change the relative position of the knife within said slot without shaft rotation and independently of the rotational position of the shaft.

13. The knife assembly of claim 12, said fluid-actuated mechanism comprising an elongated bladder formed of resilient material, said structure including means for selectively and alternately filling and draining the bladder with fluid, said knife-engaging means including a laterally shiftable plate defining one of said walls and movable in response to pressurization and depressurization of said bladder.

* * * * *